US007243688B2

(12) United States Patent
Stark

(10) Patent No.: US 7,243,688 B2
(45) Date of Patent: Jul. 17, 2007

(54) DEVICE FOR REFORMING SOCKET CONTACTS

(75) Inventor: Michael R. Stark, Tempe, AZ (US)

(73) Assignee: Intel Corporation, Santa Clara, CA (US)

( * ) Notice: Subject to any disclaimer, the term of this patent is extended or adjusted under 35 U.S.C. 154(b) by 257 days.

(21) Appl. No.: 10/901,702

(22) Filed: Jul. 29, 2004

(65) Prior Publication Data

US 2006/0021669 A1 Feb. 2, 2006

(51) Int. Cl.
*B21F 1/02* (2006.01)

(52) U.S. Cl. ..... 140/147; 140/123; 72/462; 72/460; 7/107

(58) Field of Classification Search ..... 81/439, 81/442, 454, 455; 7/107, 108; 140/123, 140/147, 106, 117; 72/462, 460; 606/210, 606/133; 294/99.2

See application file for complete search history.

(56) References Cited

U.S. PATENT DOCUMENTS 604,250 A * 5/1898 Jocelyn ..... 81/455
688,799 A * 12/1901 Stern ..... 81/455
1,157,969 A * 10/1915 Tobin ..... 81/455
1,501,222 A * 7/1924 Sampson ..... 81/439
1,521,268 A * 12/1924 Arsenault ..... 81/455
1,912,317 A * 5/1933 Stewart ..... 81/455
2,175,299 A * 10/1939 Malvin ..... 81/455
2,484,655 A * 10/1949 Shreve ..... 81/454
2,546,489 A * 3/1951 Wright ..... 71/108
2,654,632 A * 10/1953 Herbert ..... 294/116
2,740,435 A * 4/1956 Pritts ..... 140/147
2,783,525 A * 3/1957 Scharf ..... 228/5.1
2,942,637 A * 6/1960 Larsen ..... 81/455
3,628,202 A * 12/1971 Brown et al. ..... 7/107
3,880,205 A * 4/1975 Linker et al. ..... 140/147
3,901,298 A * 8/1975 Eby ..... 81/455
3,948,298 A * 4/1976 Braden ..... 140/147
4,363,250 A * 12/1982 Suga ..... 81/455
4,829,669 A * 5/1989 Nakajima ..... 29/874
5,203,382 A * 4/1993 Barnhart et al. ..... 140/123
5,431,197 A * 7/1995 Linker et al. ..... 140/147
5,479,669 A * 1/1996 Chen ..... 7/107
5,601,123 A * 2/1997 Linker et al. ..... 140/147
5,730,191 A * 3/1998 Cooper et al. ..... 140/123
5,826,630 A * 10/1998 Moore et al. ..... 140/147

* cited by examiner

*Primary Examiner*—Dmitry Suhol
(74) *Attorney, Agent, or Firm*—Schwabe, Williamson & Wyatt, P.C.

(57) ABSTRACT

An apparatus for reworking contacts of sockets is provided with an elongated member having a first formation tip, and a pair of arms having second formation tips, to respectively impart first and second profiles to first and second surfaces of a contact of a socket.

21 Claims, 7 Drawing Sheets

DEVICE FOR REFORMING SOCKET CONTACTS

TECHNICAL FIELD & BACKGROUND

Embodiments of the present invention are related to the field of electronics; and in particular, to the reformation of socket contacts of electronic apparatuses.

Modern electronic apparatuses often employ sockets having contacts disposed therein at predetermined positions. Further, the contact surfaces often have desired shapes or profiles. With modern surface mounted metallic spring contact sockets, e.g. Land Grid Array sockets, the contacts are often made of relatively thin materials, and therefore, relatively fragile. As a result, there is a significant probability that mechanical damage and deformation could occur, e.g. during system integration assembly.

Currently there are no devices designed for reforming damaged socket contacts (restoring their shapes/profiles), such as surface mounted metallic spring contact sockets, especially not in a repeatable manner. Under the present state of the art, damaged contacts, such as bent contacts, are often reformed using ad-hoc devices, such as tweezers. However, the ability to restore the shape/profile of a damaged contact to its original position and/or shape/profile using an ad-hoc device, such as a pair of tweezers, is limited. The options to successfully rework damaged contacts at the system level or in the field are often limited to replacement of the motherboard, or thermally unmounting and remounting another socket using surface mount techniques.

BRIEF DESCRIPTION OF THE DRAWINGS

Embodiments of the present invention will be described referencing the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that alternate embodiments may be practiced with only some of the described aspects. For purposes of explanation, specific numbers, materials and configurations are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments.

Various operations will be described as multiple discrete operations, in turn, in a manner that is most helpful in understanding the various embodiments of the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment. However, it may. The terms "comprising", "having", and "including" are synonymous, unless the context dictates otherwise. Similarly, the terms "shape" and "profile", for the purpose of this application, are synonymous, unless the context dictates otherwise.

Figure 1:
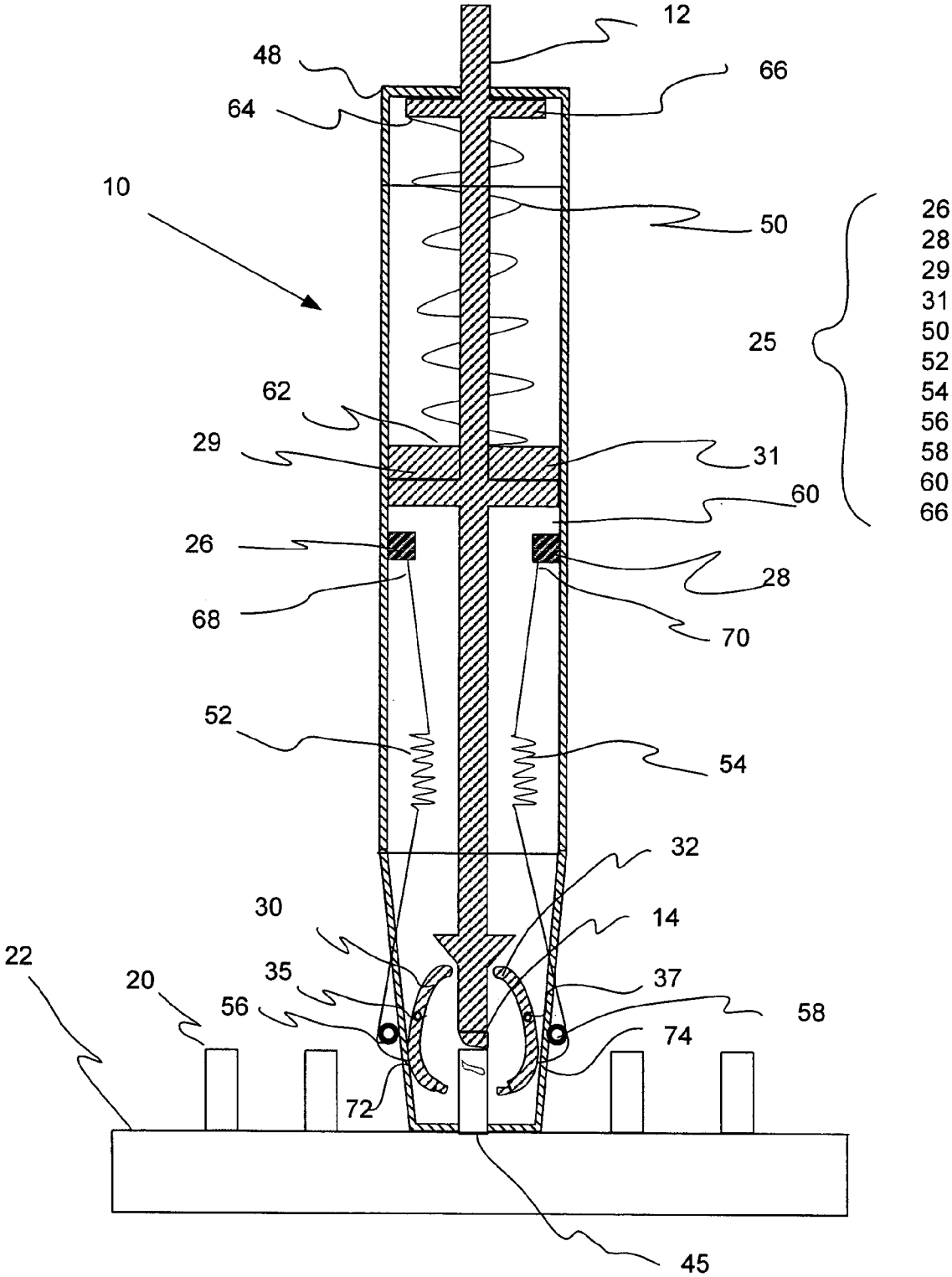
FIG. 1 illustrates a cross-sectional view of an apparatus with formation tips adapted to impart profiles to surfaces of a socket contact, with the apparatus in an unengaged position, in accordance with one embodiment.
Figure 2:
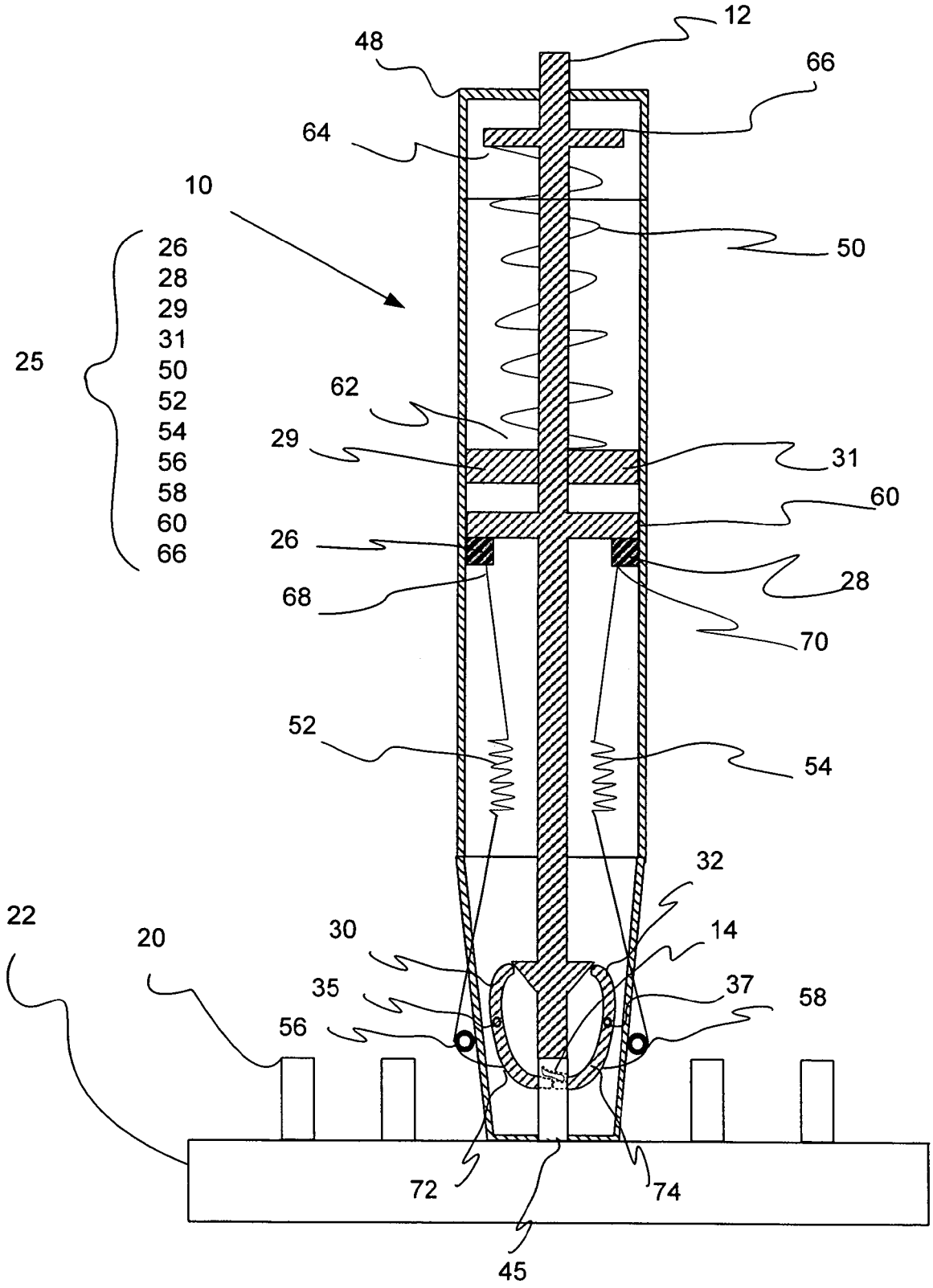
FIG. 2 illustrates another cross-sectional view of the apparatus of FIG. 1, with the apparatus in an engaged position.

FIGS. 1-2 show a cross-sectional view, one each, of one embodiment of a device 10 for reworking a damaged contact 20 of a socket 22. Contact 20 may be considered damaged for a variety of reasons, including, but are not limited to, having been bent out of position. In FIG. 1, device 10 is shown in an unengaged position, whereas in FIG. 2, device 10 is shown in an engaged position. The terms "unengaged" and "engaged", as used herewith, refer to whether the reformation elements of device 10 (to be described in more detail below) are engaged with a damaged contact or not.

Figure 6A:
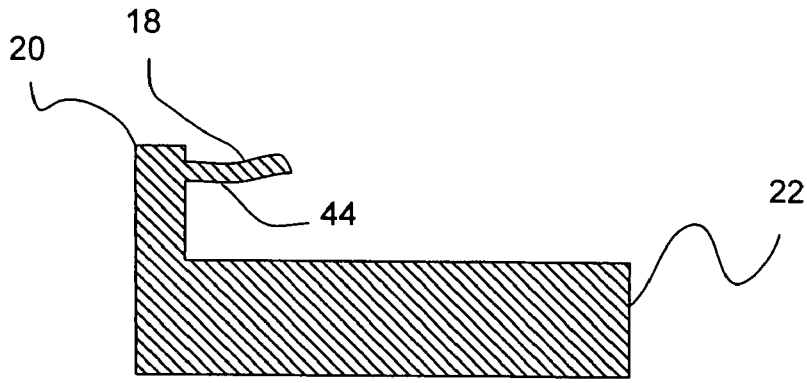
FIG. 6*a* illustrates a cross-sectional view of a surface profile of a socket contact, in accordance with one embodiment.
Figure 6B:
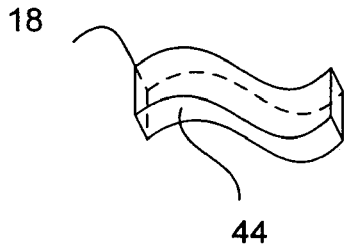
FIG. 6*b* illustrates a perspective view of another profile of another surface of the contact of FIG. 6*a*, in accordance with one embodiment.
Figure 7:
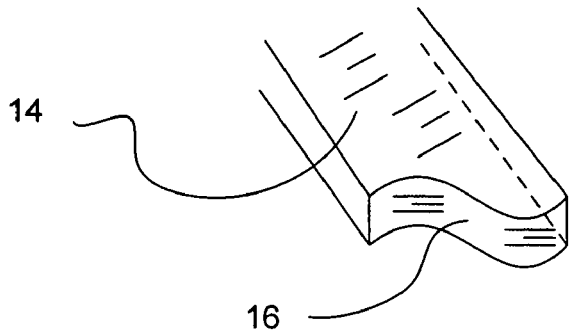
FIG. 7 illustrates a zoomed-in truncated view of an end portion of the elongated member of FIG. 1, in accordance with one embodiment.

As illustrated, device 10 includes an elongated member 12, which is provided with a first formation tip 14 disposed at a first end of elongated member 12. First formation tip 14 is configured with a first surface shape 16 (FIG. 7) for imparting a first profile to a first surface 18 of a contact 20 (FIGS. 6*a* and 6*b*), after elongated member 12 is engaged with the contact 20, e.g. during reformation or reworking of the contact 20.

Further, device 10 includes a number of support features 25 (to be described more fully below) adapted to support/facilitate moving elongated member 12 between the unengaged position (FIG. 1) and the engaged position (FIG. 2). In various embodiments, the movement of elongated member 12 between the unengaged and engaged positions may be substantially linear. For ease of understanding, elongated member 12 may be thought of as a plunger, moveable between the two positions. When viewed from a vertical orientation, the movement between the two positions may be considered as downward and upward movements. Support features 25 will be further described below.

Figure 5:
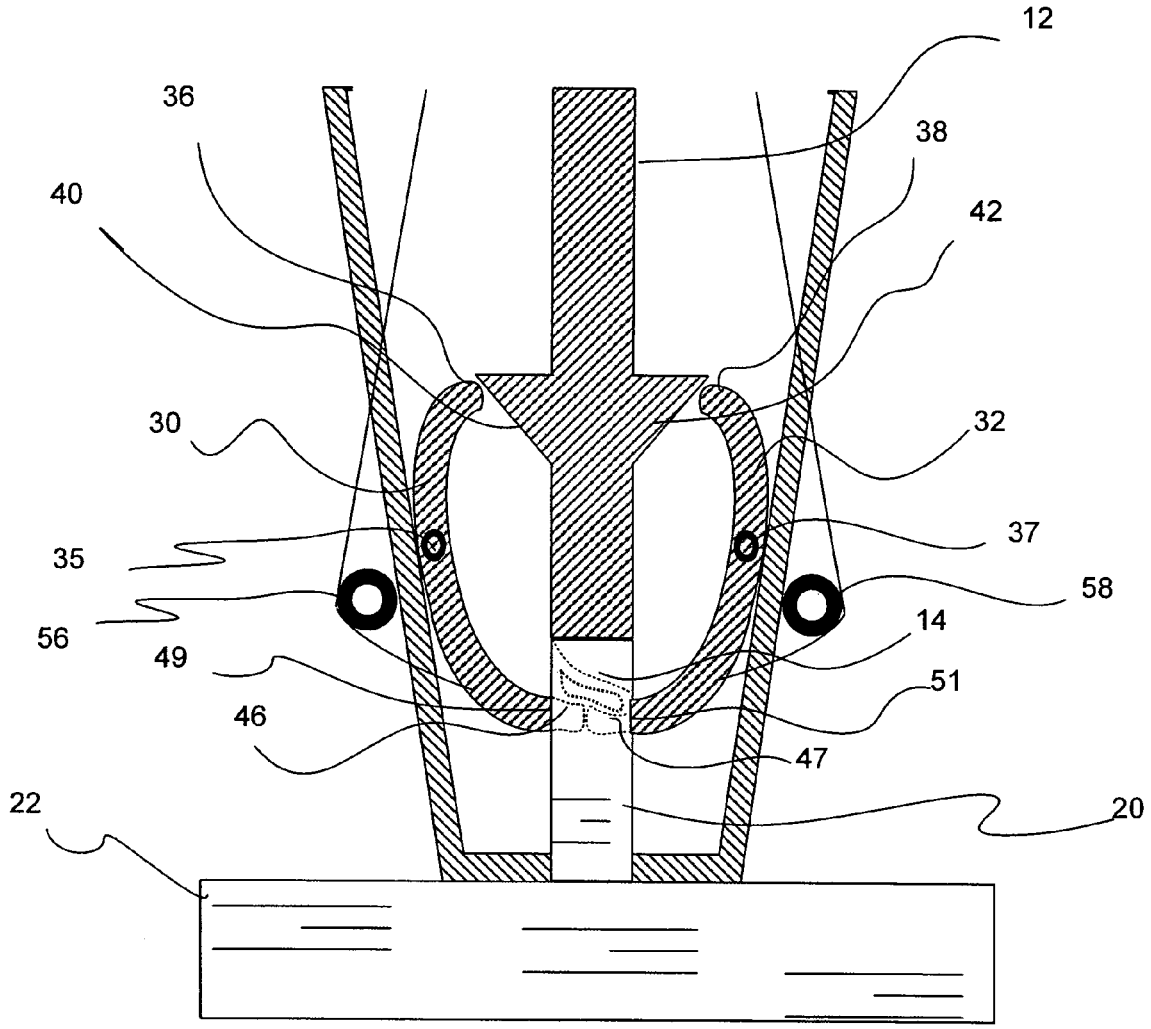
FIG. 5 illustrates a zoomed-incross-sectional view of an end portion of the apparatuses of FIG. 1-3, in accordance with one embodiment.

As illustrated, when elongated member 12 is in the unengaged position (FIG. 1), first formation tip 14 is not engaged with first surface 18 (FIGS. 6*a* and 6*b*) of contact 20 (see also zoomed-inview of FIG. 5). However, when elongated member 12 is moved to the engaged position (FIG. 2), first formation tip 14 is engaged with contact 20.

Additionally, as illustrated in more detail in the zoomed-inview of FIG. 5, for the illustrated embodiment, elongated member 12 is further adapted with actuating surfaces 40 and 42, while device 10 is further adapted with one or more arms 30 and 32. For the embodiment, actuating surfaces 40 and 42 are slanted or angular. Arms 30 and 32 are pivotally mounted at pivot points 35 and 37, and each has a cam surface 36/38. These elements (30, 32, 35-38, 40 and 42) are designed such that arms 30 and 32 are in an unengaged or open position (FIG. 1) when actuating surfaces 40 and 42 are not engaged with cam surfaces 36 and 38. However, when actuating surfaces 40 and 42 respectively engage cam surfaces 36 and 38, arms 30 and 32 pivot, and move from the open/unengaged position to a closed/engaged position (FIG. 2).

Further, each of arms 30 and 32 has a portion 46/47 of a second formation tip, respectively disposed at or adjacent to second ends 49 and 51. Portions 46 and 47 of the second formation tip are configured to jointly impart a second profile to a second surface 44 of contact 20 (FIGS. 6*a* and 6*b*) when arms 30 and 32 are in the closed/engaged position.

In various embodiments, actuating surfaces 40 and 42 are moved to engage cam surfaces 36 and 38 to move arms 30 and 32 from the open/unengaged position to the closed/engaged position, when elongated member 12 is moved from the unengaged position to the engaged position. In various embodiments, movement of arms 30 and 32 are synchronous with movement of elongated member 12.

Referring again to FIG. 1, for the illustrated embodiment, device 10 also has a housing 48 adapted to house and support elongated member 12, and arms 30 and 32. More specifically, for the illustrated embodiment, housing 48 includes an end with an opening 45, that allows first formation tip 14 and portions 46 and 47 of the second formation tip (FIG. 5) to respectively engage surfaces 18 and 44 (FIGS. 6*a* and 6*b*) of contact 20, while elongated member 12 is moved from the unengaged position to the engaged position, and arms 30 and 32 are moved from the open/unengaged position to the closed/engaged position.

As described earlier, device 10 includes a number of support features 25 adapted to support/facilitate moving of elongated member 12 between the unengaged position and the engaged position, and moving arms 30 and 32 between the open/unengaged position and the closed/engaged position. For the illustrated embodiment, support features 25 include complementary features provided to elongated member 12 and features provided to housing 48. The features provided to elongated member 12 include stop 60 and spring retention component 66. The features provided to housing 48 include one or more engagement stops 26 and 28, one or more disengagement stops 29 and 31, elongated member return spring 50, one or more arm return springs 52 and 54, and spacers 56 and 58 (FIG. 5) for arm return springs 52 and 54, respectively.

For the illustrated embodiment, engagement stops 26 and 28 are affixed to the inside of the housing 48. Engagement stops 26 and 28 are designed to engage stop 60 of elongated member 12 to prevent further "downward" movement of elongated member 12 when it reaches the engaged position from the unengaged position. Recall that, with elongated member 12 at the engaged position, first formation tip 14 would mate with first surface 18 (FIG. 5) of contact 20, imparting a profile to first surface 18, while the respective portions 46 and 47 (FIGS. 6*a* and 6*b*) of the second formation tip would mate with second surface 44 (FIGS. 6*a* and 6*b*) of contact 20, imparting a profile to second surface 44.

In various embodiments, stop 60 is formed with protruding wing sections that are substantially perpendicular to elongated member 12. In alternate embodiments, stop 60 may comprise a collar attached to elongated member 12.

In various embodiments, disengagement stops 29 and 31 are attached to the inside of the housing 48. Disengagement stops 29 and 31 are designed to engage stop 60 to stop further "upward" movement of elongated member 12 after it reaches the unengaged position in returning from the engaged position.

For the illustrated embodiment, elongated member return spring 50 has a first end 62 and a second end 64. Elongated member return spring first end 62 is coupled to disengagement stops 29 and 31 on a surface opposite of the one that engages stop 60 of elongated member 12. Elongated member return spring second end 64 is coupled to spring retention component 66 of elongated member 12. Similar to stop 60, spring retention component 66 may comprise protruding wing sections that are substantially perpendicular to the main portion of elongated member 12, or it may be formed by attaching a collar or other features of the like to elongated member 12.

For the illustrated embodiment, arm return springs 52 and 54 respectively have first ends 68 and 70. Arm return springs first ends 68 and 70 may be respectively attached to engagement stops 26 and 28. Additionally, arm return springs 52 and 54 also have second ends 72 and 74, respectively. For the illustrated embodiment, housing 48 includes a number of side openings, allowing second ends 72 and 74 to be respectively threaded through a first set of these side openings, over externally disposed spacers 56 and 58, then through a second set of side openings, to be finally attached to arms 30 and 32. Arms 30 and 32 may also be referred to as "a pair of arms".

Figure 3:
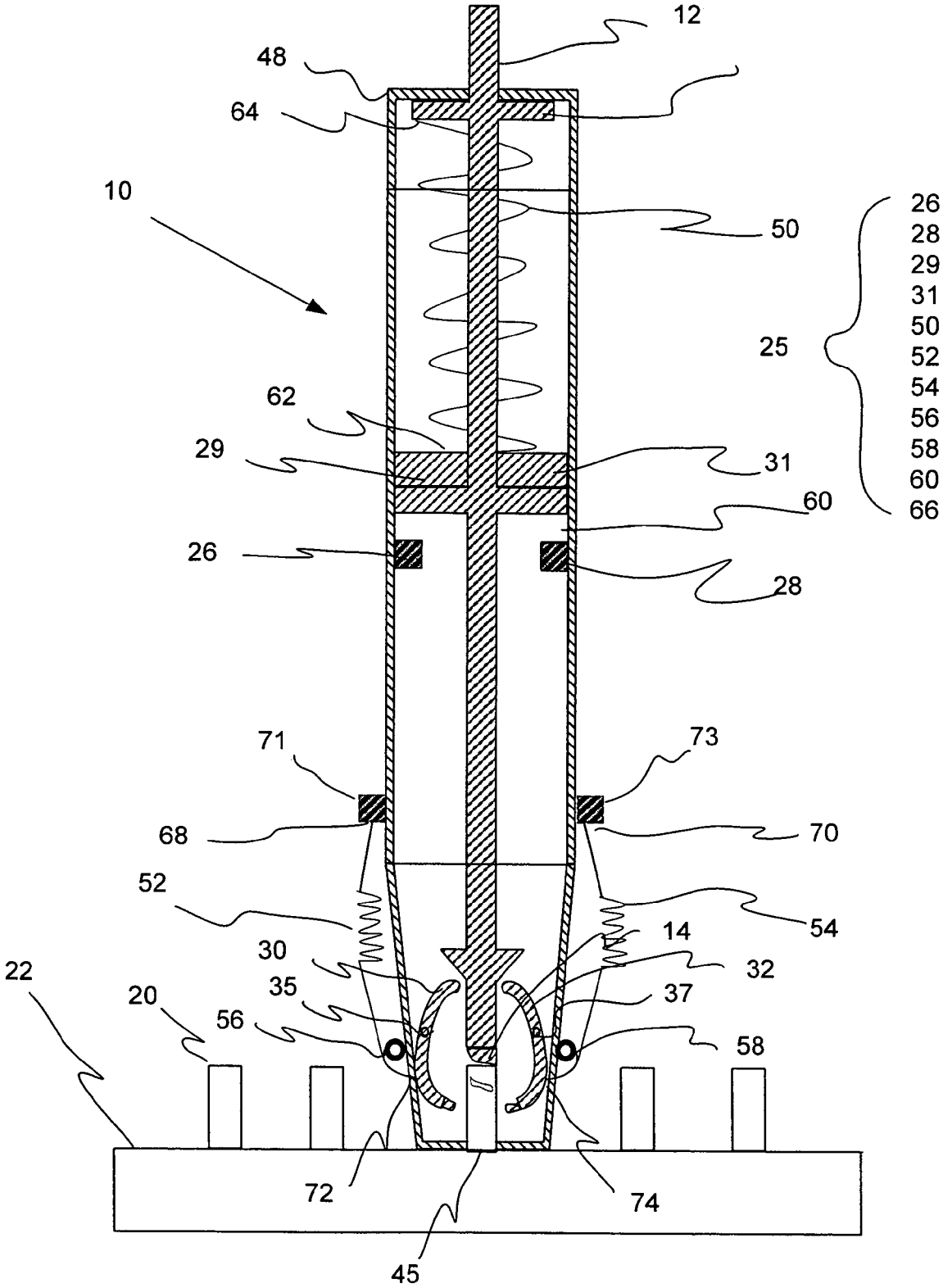
FIG. 3 illustrates a cross-sectional view of a similar apparatus, where the arm springs are disposed at the exterior of the apparatus, in accordance with an alternate embodiment.

FIG. 3 illustrates an alternate embodiment of device 10. For this embodiment, an external arrangement of arm returns springs 52 and 54 is employed. In particular, arm return springs first ends 68 and 70 may be respectively attached to externally disposed arm return spring anchors 71 and 73, while arm return springs second ends 72 and 74 remain respectively attached to arms 30 and 32.

Figure 8:
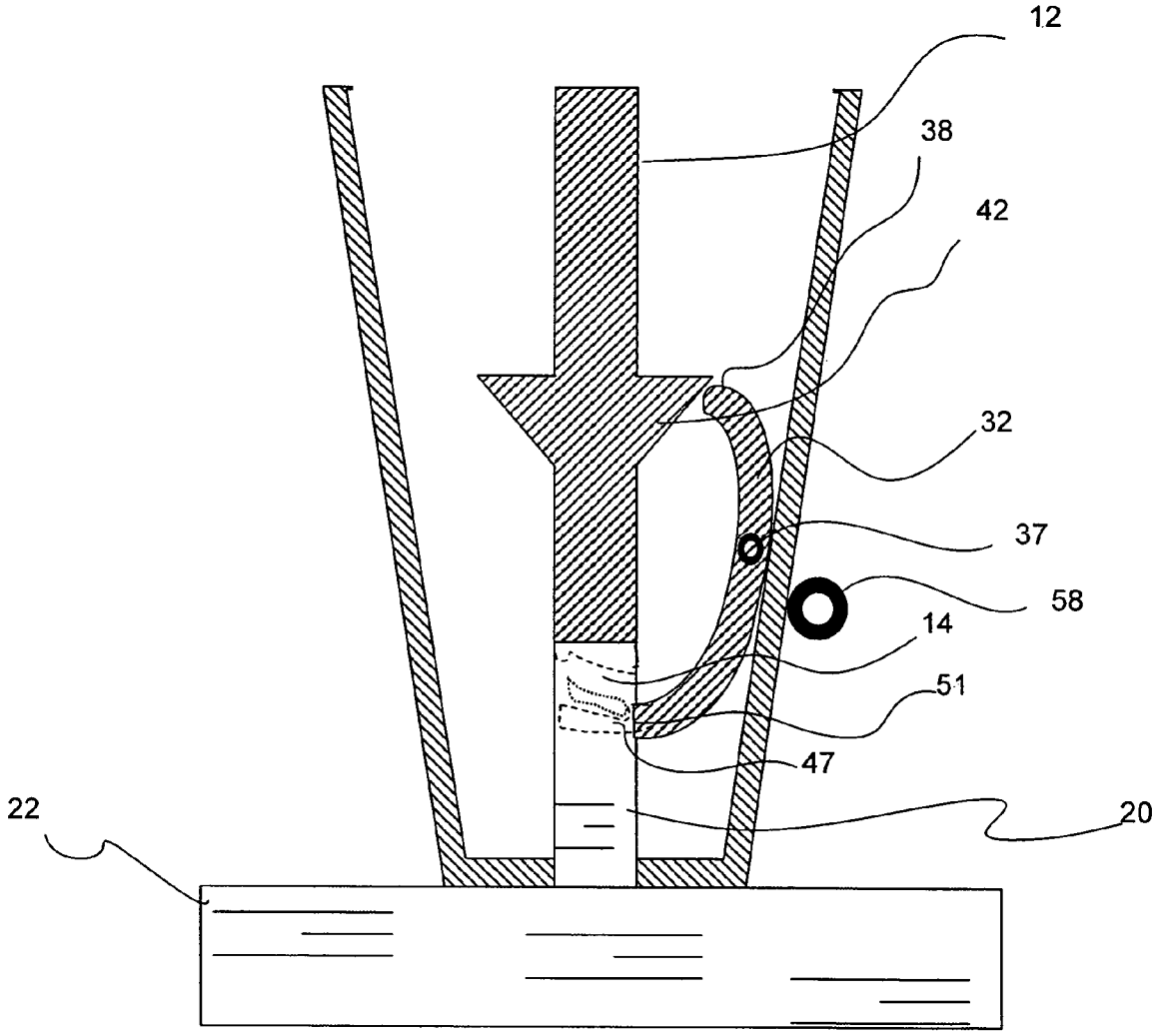
FIG. 8 illustrates a cross-sectional view of a portion of a similar apparatus, with only one arm, in accordance with another alternate embodiment.

FIG. 8 illustrates still another alternate embodiment of device 10, For this embodiment, one pivotably movable arm 32 is employed (in lieu of a pair of arms 30 and 32 of the embodiments of FIGS. 1, 2 and 3).

Figure 4:
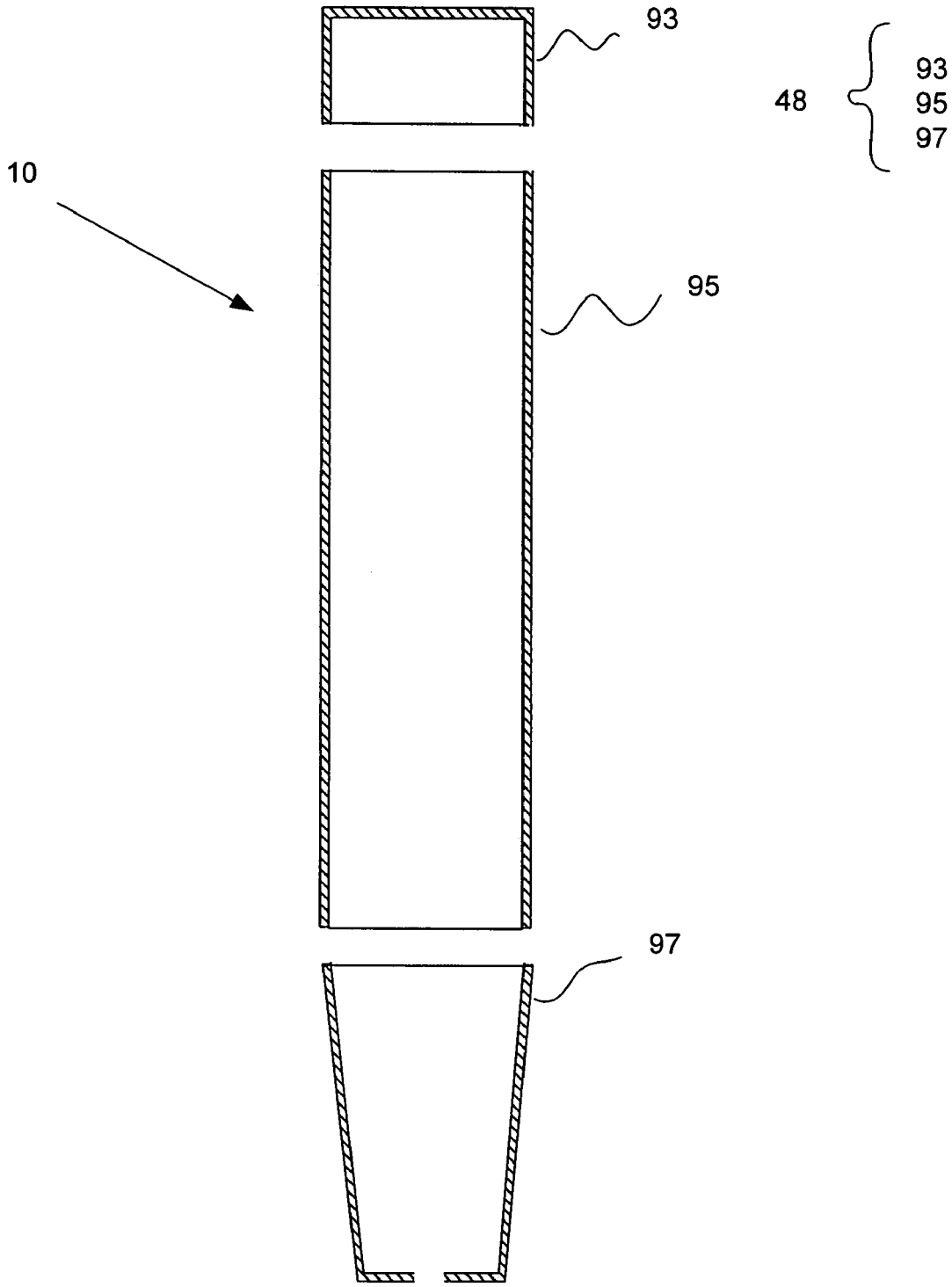
FIG. 4 illustrates an exploded cross-sectional view of the body portions of the apparatuses of FIGS. 1-3, in accordance with one embodiment.

FIG. 4 illustrates housing 48 in further detail, in accordance with one embodiment. For the illustrated embodiment, housing 48 may comprise three portions with a top portion 93 and a bottom portion 97 attached to a center main portion 95 on opposite ends. In particular, for the illustrated embodiment, bottom portion 97 may be tapered, and include the earlier described side and bottom openings.

Top portion 93 and/or bottom portion 97 may be attached to center main portion 95 by employing a threaded screw type of attachment arrangement. In alternate embodiments, top portion 93 and/or bottom portion 97 may be attached to center main portion 95 by employing a friction fit type of attachment arrangement.

In various embodiments, each of portions 93, 95, and 97 may be made of the same or different material. In various embodiments, the various materials include, but are not limited to, metal and plastic tubing.

Referring again to FIGS. 1 and 2, for various embodiments, the one or more engagement stops 26 and 28 and disengagement stops 29 and 31 may be made of stamped metal pressed into housing 48, and in particular, into center main portion 95 (FIG. 4). In other various embodiments, the stamped metal may be doughnut shaped.

Similarly, the return arm spring anchors 71 and 73 (FIG. 3) may be made of a stamped metal, and may further be doughnut shaped. The return arm spring anchors 71 and 73 may be attached by pressing the anchors into the center main portion 95 or onto bottom portion 97 (FIG. 4). In alternate embodiments, other suitable and common methods for affixing the return arm spring anchors 71 and 73 may be employed instead.

In various embodiments, the one or more arms 30 and 32 may be first pivotally mounted to bottom portion 97 with pins (not shown) that act as pivot points 35 and 37. Thereafter, bottom portion 97 may be attached to center main portion 95. Next, the second ends 72 and 74 of the one or more arm return springs 52 and 54 may be attached to arm return spring attach points (not shown) on the one or more arms 30 and 32 through the side openings (not shown) of bottom portion 97.

In various embodiments, the first ends 68 and 70 of the one or more arm return springs 52 and 54 may be affixed to engagement stops 26 and 28, as shown in FIGS. 1 and 2. Other embodiments may have the first ends 68 and 70 of the one or more return arm springs 52 and 54 attached to externally disposed arm return spring anchors 71 and 73, as shown in FIG. 3.

Accordingly, device 10 may be employed to reform a damaged contact 20 of a socket, by first placing device 10 in the unengaged position (FIG. 1) over the damaged contact 20 (through opening 45 of housing 48). Then, elongated member 12 may be moved downward placing device 10 in the engaged position. As described earlier, arms 30 and 32 are also moved from the open position to the closed position. As a result, elongated member 12 is engaged on first surface 18 (FIGS. 6*a* and 6*b*) of the damaged contact 20, with first formation tip 14 imparting a profile to first surface 18. Substantially at the same time, the respective portions 46 and 47 of the second formation tip a profile to second surface 44 (FIGS. 6*a* and 6*b*) of contact 20.

Thereafter, elongated member 12 may be moved upward, placing device 10 back in the unengaged position, and arms 30 and 32 back in the open position. Device 10 may then be withdrawn, leaving contact 20 reformed.

The process may be repeated consistently for other damaged contacts of the same or different sockets. Accordingly, device 10 represents a significant improvement over the present state of art, especially when contrasted with the typical use of ad hoc apparatus, such as tweezers.

Thus, a novel device for reforming damaged socket contacts has been described. While the present invention has been described in terms of the foregoing embodiments, those skilled in the art will recognize that embodiments of the present invention are not limited to the embodiments described. Alternate embodiments may be practiced with modifications and alterations while remaining within the spirit and scope of the appended claims. Therefore, the description is to be regarded as illustrative instead of restrictive.

What is claimed is:

1. An apparatus comprising:

a first arm having an end;

an elongated member having an end, a first formation tip disposed at the end, with the first formation tip having a first shape, and an actuating feature; and a housing to house and support the elongated member and the first arm, including a first support feature adapted to allow the elongated member to be movable between a first unengaged position and a first engaged position, wherein at the first engaged position, the elongated member engages a first surface of a contact of a socket disposed underneath the apparatus, to allow the first formation tip to impart a first profile to the first surface of the contact and the actuating feature engages the first arm such that the end of the first arm engages a second surface of the contact.

2. The apparatus of claim 1, wherein the elongated member further includes a protruding feature extending away from the elongated member; and the first support feature of the housing includes a stop disposed inside the housing and adapted to engage the protruding feature of the elongated member to render the elongated member immovable in a downward direction when the elongated member reaches the first engaged position.

3. The apparatus of claim 1, wherein the elongated member further includes a protruding feature extending away from the elongated member; and the first support feature of the housing includes a stop disposed inside the housing and adapted to engage the protruding feature of the elongated member to render the elongated member immovable in an upward direction when the elongated member reaches the first unengaged position.

4. The apparatus of claim 1, wherein the elongated member further includes a protruding feature extending away from the elongated member; and the first support feature of the housing includes a spring disposed inside the housing and adapted to be compressed by the protruding feature of the elongated member, as the elongated member is moved from the first unengaged position to the first engaged position, to assist in returning the elongated member from the first engaged position to the first unengaged position.

5. The apparatus of claim 1, wherein the apparatus further comprises the first and a second arm respectively coupled to a first side and a second side of the housing, and moveable between a second unengaged position and a second engaged position, the end of the first arm and an end of the second arm forming a second formation tip having a second shape, to engage the second surface of the contact when the arms are in the second engaged position, to allow the second formation tip to impart a second profile to the second surface of the contact.

6. The apparatus of claim 5, wherein the actuating feature extends away from the elongated member towards both arms to engage both arms to move the arms from the second unengaged position to the second engaged position as the elongated member is moved from the first unengaged position to the first engaged position.

7. The apparatus of claim 6, wherein the actuating feature of the elongated member comprises a first and a second angular surface to respectively engage and move the arms from the second unengaged position to the second engaged position.

8. The apparatus of claim 5, wherein the housing further comprises a second support feature adapted to allow the arms to be movable between the second unengaged position and the second engaged position.

9. The apparatus of claim 8, wherein the second support feature includes first and second pins respectively disposed at a first and a second side of the housing pivotally attaching the arms to the housing.

10. The apparatus of claim 8, wherein the second support feature includes a first and a second spring respectively coupled to the first and second arms, to assist in returning the first and second arms from the second engaged position to the second unengaged position.

11. The apparatus of claim 10, wherein the first and second springs are further coupled to the elongated member.

12. The apparatus of claim 10, wherein the first and second springs are disposed inside the housing.

13. apparatus of claim 10, wherein the first and second springs are disposed outside the housing.

14. The apparatus of claim 1, wherein the first arm is coupled to a side of the housing, and moveable between a second unengaged position and a second engaged position, with the end of the first arm forming a second formation tip having a second shape, to engage the second surface of the contact when the first arm is in the second engaged position, to allow the second formation tip to impart a second profile to the second surface of the contact.

15. A method comprising:

engaging an elongated member having a first formation tip with a first shape, with a first surface of a contact of a socket to impart a first profile to the first surface of the contact; and engaging a first and a second arm respectively having a first and a second end forming a second formation tip with a second shape, with a second surface of the contact to impart a second profile to the second surface of the contact.

16. The method of claim 15, wherein said engaging of the elongated member with the first surface of the contact comprises moving the elongated member from a first unengaged position to a first engaged position.

17. The method of claim 16, wherein said engaging of the arms with the second surface of the contact comprises moving the arms from a second unengaged position to a second engaged position.

18. The method of claim 17, wherein said moving of the elongated member, and said moving of the arms are performed synchronously.

19. The method of claim 15, wherein said engaging of the arms with the second surface of the contact comprises moving the arms from the second unengaged position to the second engaged position.

20. A method comprising:

engaging an elongated member having a first formation tip with a first shape, with a first surface of a contact of a socket to impart a first profile to the first surface of the contact;

engaging an arm having a second formation tip with a second shape, with a second surface of the contact to impart a second profile to the second surface of the contact; and engaging the arm with an actuating feature of the elongated member to facilitate said engaging of the arm with the second surface.

21. The method of claim 20, wherein said engaging of the arm with the second surface of the contact comprises moving the arm from a first unengaged position to a first engaged position.

* * * * *